US007743810B2

(12) United States Patent
Rolion et al.

(10) Patent No.: US 7,743,810 B2
(45) Date of Patent: Jun. 29, 2010

(54) CORRECTION SYSTEM WITH RUBBER ELASTIC TENSION ELEMENT FOR A GEAR MECHANISM CORRECTION TAPE

(75) Inventors: Franck Rolion, Asnières sur Oise (FR); Arnaud Bez, Villed d'Avray (FR)

(73) Assignee: Societe BIC, Clichy (FR)

( * ) Notice: Subject to any disclaimer, the term of this patent is extended or adjusted under 35 U.S.C. 154(b) by 807 days.

(21) Appl. No.: 11/571,924

(22) Filed: Jan. 10, 2007

(65) Prior Publication Data

US 2009/0205785 A1 Aug. 20, 2009

(30) Foreign Application Priority Data

Jan. 12, 2006 (EP) ..... 06000617

(51) Int. Cl.
*B65H 18/08* (2006.01)
*F16D 7/02* (2006.01)

(52) U.S. Cl. ..... 156/574; 156/577; 192/56.1; 242/538.1

(58) Field of Classification Search ..... 156/574, 156/577
See application file for complete search history.

(56) References Cited

U.S. PATENT DOCUMENTS 5,049,229 A * 9/1991 Czech ..... 156/577
6,808,565 B1 10/2004 Koyama et al.
7,118,064 B2 * 10/2006 Schneider ..... 242/538.1
2003/0226733 A1 * 12/2003 Huthmacher et al. ..... 192/56.1

FOREIGN PATENT DOCUMENTS

DE 42 17 295 A1 12/1993
EP 1 186 562 A 3/2002
EP 1 422 146 A 5/2004

* cited by examiner

*Primary Examiner*—Khanh Nguyen
*Assistant Examiner*—Margaret Squalls
(74) *Attorney, Agent, or Firm*—Jones Day

(57) ABSTRACT

A frictional clutch for a correction device includes a rotatable supply reel with a circular center opening and a rotatable take-up reel being laterally arranged spaced apart from the supply reel, the take-up reel having an outer circumferential surface onto which a correction tape is to be wound up and the supply reel having an outer circumferential surface from which the correction tape is to be wound off, wherein the outer circumferential surface of the supply reel is provided with a circumferential radial groove in which an elastic tensioning element is accommodated, the radial circumferential groove being at its bottom at least partially transected such that the elastic tensioning element projects into the center opening secantically, when it is in a stress-relieved condition.

12 Claims, 4 Drawing Sheets

CORRECTION SYSTEM WITH RUBBER ELASTIC TENSION ELEMENT FOR A GEAR MECHANISM CORRECTION TAPE

This application claims priority under 35 U.S.C. §119 to EP 06 000 617.8, filed on Jan. 12, 2006, the entire contents of which is hereby incorporated by reference.

FIELD OF INVENTION

An embodiment of the present invention relate to a frictional clutch and driving mechanism for a correction.

BACKGROUND OF INVENTION

Generally the embodiments of the present invention relate to so-called correction tape dispensers or correction devices which are adapted to apply a correction tape on a substrate.

The use of a frictional clutch in a correction device is known in the prior art. The frictional clutch serves for creating drive adjustment for a take-up reel of the correction device for transferring a film from a backing tape onto a substrate, whereby the take-up reel is being driven such that the backing tape portion being supplied to the take-up reel is always slightly tensioned. The frictional clutch should ensure that a predetermined tension is not exceeded so that the backing tape is not disrupted.

An example for such a frictional clutch comprises a supply reel for feeding a coating film transfer tape and a take-up reel for recovery of the used coating film transfer tape which are both rotatably mounted in a casing. The supply reel includes a supply cylinder and a drive gear wheel having a boss. An O-ring serving as a friction member is provided on an outer periphery of the boss of the drive gear wheel whereby the supply cylinder is mounted on the outer periphery of and in friction contact with the O-ring, thus sandwiching and compressing the O-ring in between the boss and the supply cylinder.

However, these frictional clutch systems know in the prior art have the disadvantage that due to tolerances of the components, namely the boss of the drive gear wheel and/or the supply reel cylinder, of only a few tenths of a millimeter, these deviations have a great influence on the resulting frictional force. That means that a few tenths of a millimeter percentally result in a high variation considering the typical diameter of an O-ring of only a few millimeters. If now, the drive gear wheel boss is a few tenths of millimeters too large and/or the supply reel cylinder is only a few tenths of a millimeter too small, a very high frictional force results, rendering the clutch too hard and, thus, rupture of the backing tape has to be encountered.

Therefore, an embodiment of the present invention is based on the object to provide a frictional clutch, a driving mechanism employing the frictional clutch and a corresponding correction device, in which the frictional force of the frictional clutch is less dependent on manufacturing tolerances.

This object is solved by a frictional clutch having the features of a frictional clutch for a correction device that includes a rotatable supply reel with a circular center opening and a rotatable take-up reel being arranged laterally spaced apart from the supply reel, the take-up reel having an outer circumferential surface onto which a correction tape is to be wound up and the supply reel having an outer circumferential surface from which the correction tape is to be wound off, wherein the outer circumferential surface of at least one of supply reel and take-up reel is provided with a groove in which an elastic tensioning element is accommodated, the radial circumferential groove being at its bottom at least partially opened such that the elastic tensioning element is biased into the center opening, a driving mechanism having the features of that include a drive gear wheel (i) in the center of which a cylindrical boss is provided on which the supply wheel is arranged with circular center opening, and a driven gear wheel, on which a take-up reel is arranged, whereby the drive gear wheel (ii) engages the driven gear wheel, and a correction device having the features of a casing having an upper body and a lower body, the casing being provided with a tip opening, through which a tip for applying a correction tape onto a surface of a substrate extends; a drive gear wheel (i) in the center of which a cylindrical boss (i) is provided on which a supply reel is arranged having a center opening and a circumferential surface from which the correction tape is to be wound off; a driven gear wheel which engages the drive gear wheel (ii) and on which a take-up reel is arranged having a circumferential surface on which the correction tape is to be wound up wherein the outer circumferential surface of the supply reel is provided with a circumferential radial groove in which an elastic tensioning element is accommodated, the circumferential radial groove being at its bottom transected at least partially such that the elastic tensioning element projects into the center opening secantically, when it is in a stress-relieved condition.

According to an embodiment of the present invention, a frictional clutch for a correction device is provided that includes a rotatable supply reel with a circular center opening and a rotatable take-up reel being arranged laterally spaced apart from the supply reel, the take-up wheel having an outer circumferential surface onto which a correction tape is to be wound up and the supply reel having an outer circumferential surface from which the correction tape is to be wound off, wherein the outer circumferential surface of the supply reel is provided with a radial circumferential groove in which an elastic tensioning element is accommodated, the radial circumferential groove being at its bottom at least partially transected such that the elastic tensioning element projects into the center opening secantically, when it is in a stress-relieved condition. When the frictional clutch is employed, i.e., when mounted on a driving mechanism of a correction device, the elastic tensioning element smoothly adapts the circular shape of the supply reel or the boss, respectively, onto which the supply reel is mounted, to thus contact the circumferential surface of the boss and apply a well-defined frictional force.

According to this construction, the compression exerted on the O-ring employed in a frictional clutch known in the prior art is replaced by the circumferential expansion of the elastic tensioning element. This has the advantage that tolerances of only a few tenths of a millimeter now are minor or negligible, compared to the length of the elastic tensioning element of, e.g., three to five centimeters. These variations have only very little influence on the resulting frictional force.

Moreover, the elastic tensioning element can be preassembled on the supply reel from the outside, such that the tensioning element and the supply reel can be mounted on the supply reel boss in only one working cycle, facilitating the production of the correction tape, and, thus, reducing production costs.

The frictional clutch of an embodiment of the present invention is particularly adapted for a torque-restricting power transmission between a reel and a rotating element of a correction device for applying a film of a backing tape onto a substrate. This frictional clutch, however, can either be assigned to a supply reel or a take-up reel of the correction device.

The embodiments of the present invention and further advantages, which can be achieved by the embodiments of the present invention, will now be explained in detail by means of a preferred embodiment with reference to the drawings in which

BRIEF DESCRIPTION OF THE DRAWINGS

FIG. 1 shows a sectional side view of a correction device 1 according to prior art which can be used to erase characters of the like on a substrate.

DETAILED DESCRIPTION OF THE DRAWINGS

Figure 1:
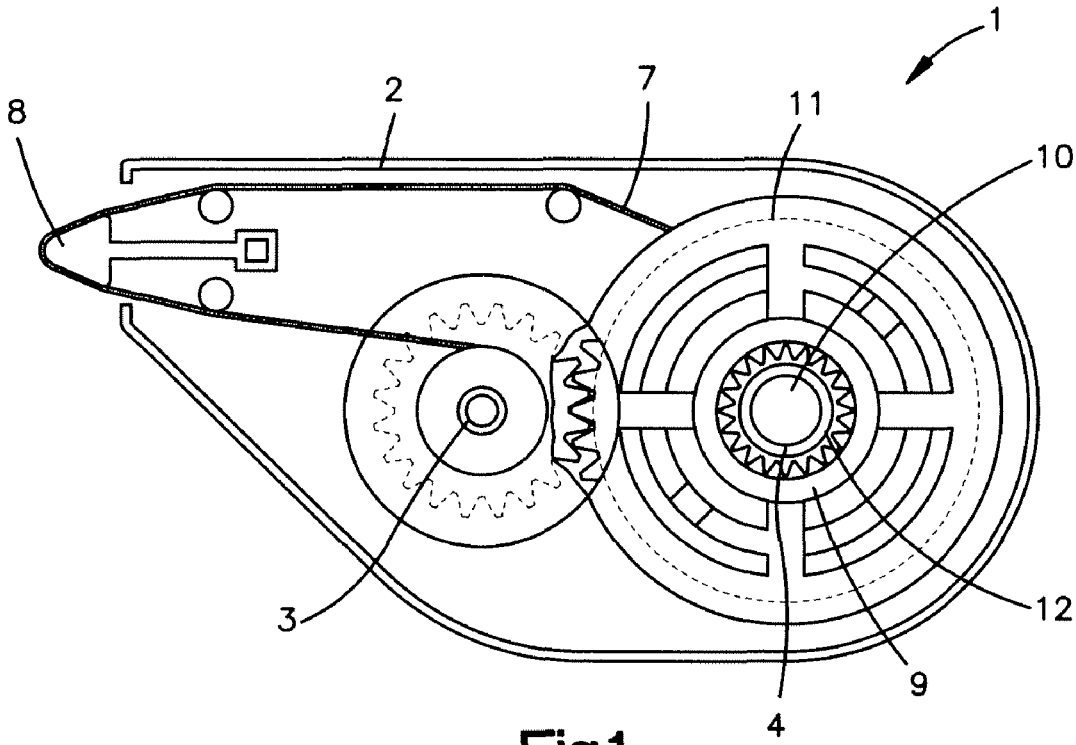
FIG. 1 shows a sectional side view of a correction device according to prior art.

The correction device 1 comprises a casing 2. On an inner surface of the casing 2, two support shafts 3 and 4 laterally spaced apart from each other are provided. Mounted on support shaft 3 is a take-up reel 5 for recovery of used coating film transfer tape 7, and mounted on support shaft 4 is a supply reel 6 for feeding the transfer tape. A coating film transfer tip 8 is provided at the forward end of the casing 2. The supply reel 6 comprises a supply reel cylinder 9 set on the outer periphery of a cylindrical boss 10 at the center of a drive gear wheel via a friction member provided in the form of an O-ring 12. The O-ring 12 is made from an elastomer and is disposed between the cylindrical boss 10 and the supply reel cylinder 9 in a compressed state.

The O-ring 12 serves for transmitting the torque acting on the supply reel cylinder 9 due to the tension of the coating film transfer tape 7 to the drive gear wheel 11 as friction torque. As the casing 2 is being moved, the tension being applied to the coating film transfer tape 7 acts as rotation torque on the supply reel cylinder 9 and the supply reel cylinder 9 rotates with the drive gear wheel 11 due to the friction force of the O-ring 12, which in turn results in further feeding of the coating film transfer tape 7.

Figure 2:
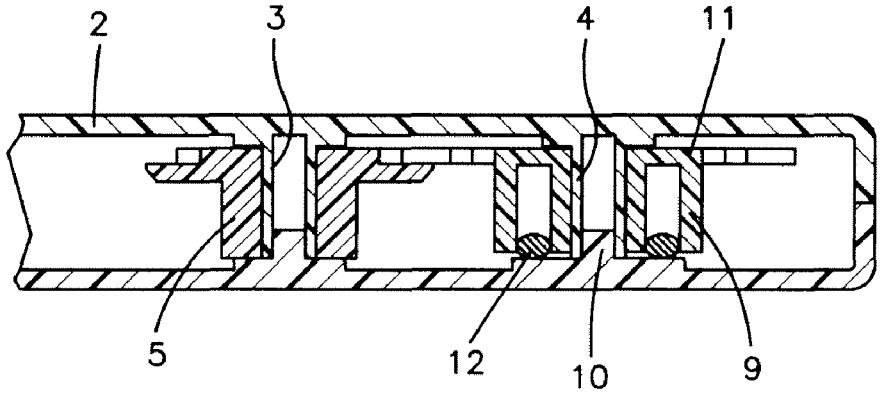
FIG. 2 shows a sectional top view on the correction device of FIG. 1.

FIG. 2 shows the correction device 1 of FIG. 1 in top view. As can be seen from FIG. 2, a support shaft or take-up reel axle boss 3 is integrally formed with and projecting inwardly from the wall of the casing 2. On support shaft or take-up reel axle boss 3, a take-up reel 5 is mounted for recovering used coating film transfer tape 7. The transfer tape 7 is supplied from the supply reel 6 mounted on the cylindrical boss 10 of the drive gear wheel 11, which in turn is mounted on support shaft or supply reel axle boss 4, formed integrally with and projecting inwardly from the wall of the casing 2. Sandwiched between the outer surface of the cylindrical boss 10 and the inner surface of the supply reel cylinder 9, an O-ring 12 is arranged there between in a compressed state.

Figure 3:
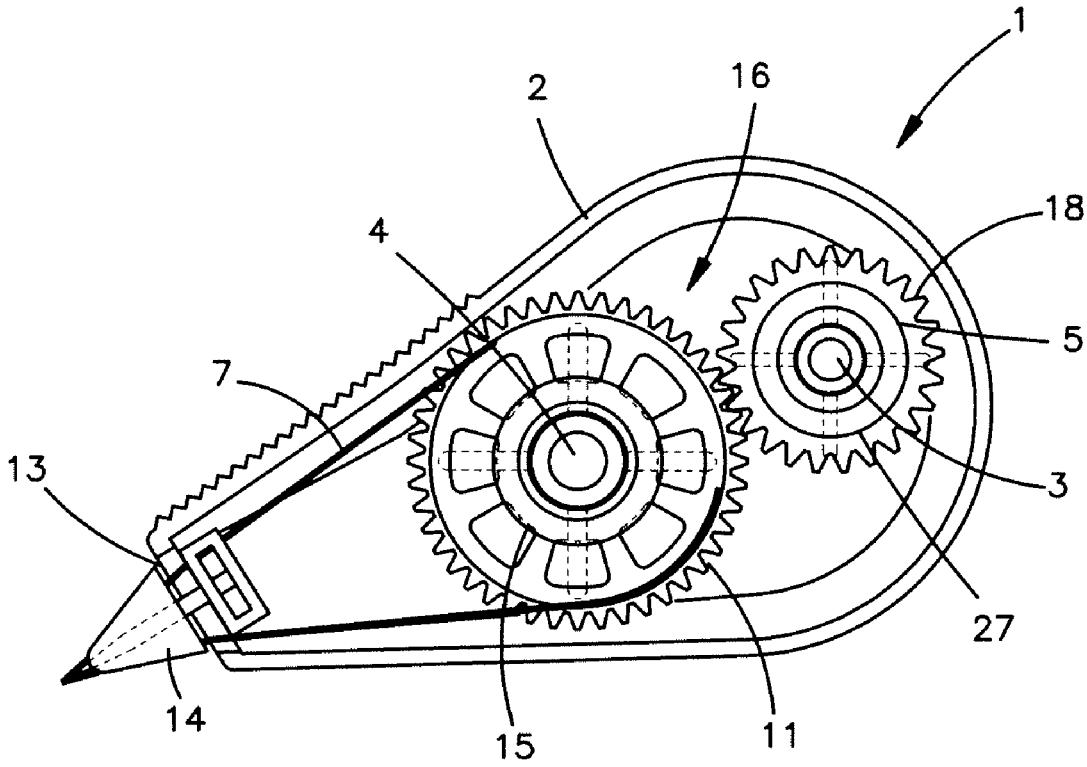
FIG. 3 shows a sectional side view of a correction device according to an embodiment of the present invention.

FIG. 3 shows a sectional side view of a correction device 1 according to an embodiment of the present invention. A casing 2 is constituted by an upper body and a lower body and has a tip opening 13 through which a tip 14 is exposed serving as an application member of the correction device 1 by means of which a coating tip transfer tape or correction tape 7 is applied onto a surface of a substrate.

The correction tape 7 is wound on an outer circumferential surface 15 of a supply reel 6. The correction tape 7 can be pulled off the supply reel 6 by pressing the tip 14 on the substrate while simultaneously displacing the correction device 1, whereby the used correction tape 7 is automatically fed back into the casing and wound onto a circumferential surface 27 of the take-up reel 5.

The take-up reel 5 is arranged on a support shaft 3 which projects from an inner surface of the upper body of the casing 2. Another shaft 4 projecting from the inner surface of the upper body of the casing 2 is provided for arranging the supply reel 6 which in turn is arranged on a drive gear wheel 11 thereon. The shafts or take-up reel axle boss 3 and supply reel axle boss 4 can, however, just as well be provided on the lower body of the casing 2. The shafts 3, 4 moreover can be formed integrally with the inner wall of a respective body of the casing 2, or they can also be provided separately on an inner wall of the casing 2. The shafts 3, 4 are arranged laterally spaced apart from each other and serve as respective axes of rotation for the take-up reel 5 and the supply reel 6, respectively.

A driving mechanism 16 with an integrated frictional clutch 17 is provided in that a driving gear wheel 11 supported on the support shaft 4 engages a driven gear wheel 18 supported on the support shaft 3. The driving gear wheel 11 has a cylindrical boss 10 on the outer periphery of which the supply reel 6 or supply reel cylinder 9, respectively, is arranged with its center opening 21.

For transmitting the torque acting on the supply reel cylinder 9 due to the tension of the correction tape 7 to the drive gear wheel 11, an elastic tensioning element 19 made from rubber is provided on the outer periphery of the supply reel 6.

Figure 4:
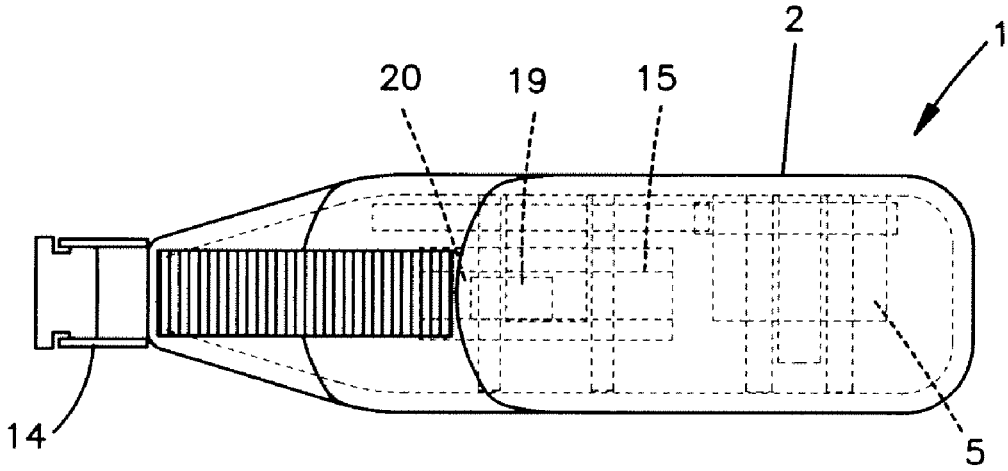
FIG. 4 shows a sectional top view on the correction device of FIG. 3.

As can be seen from FIG. 4, the supply reel 6 has on its outer circumference 15 a circumferential radial groove 20, splitting the outer circumference 15 into two halfs. The elastic tensioning element 19 is accommodated in the circumferential groove 20 of the supply reel 6.

Figure 5:
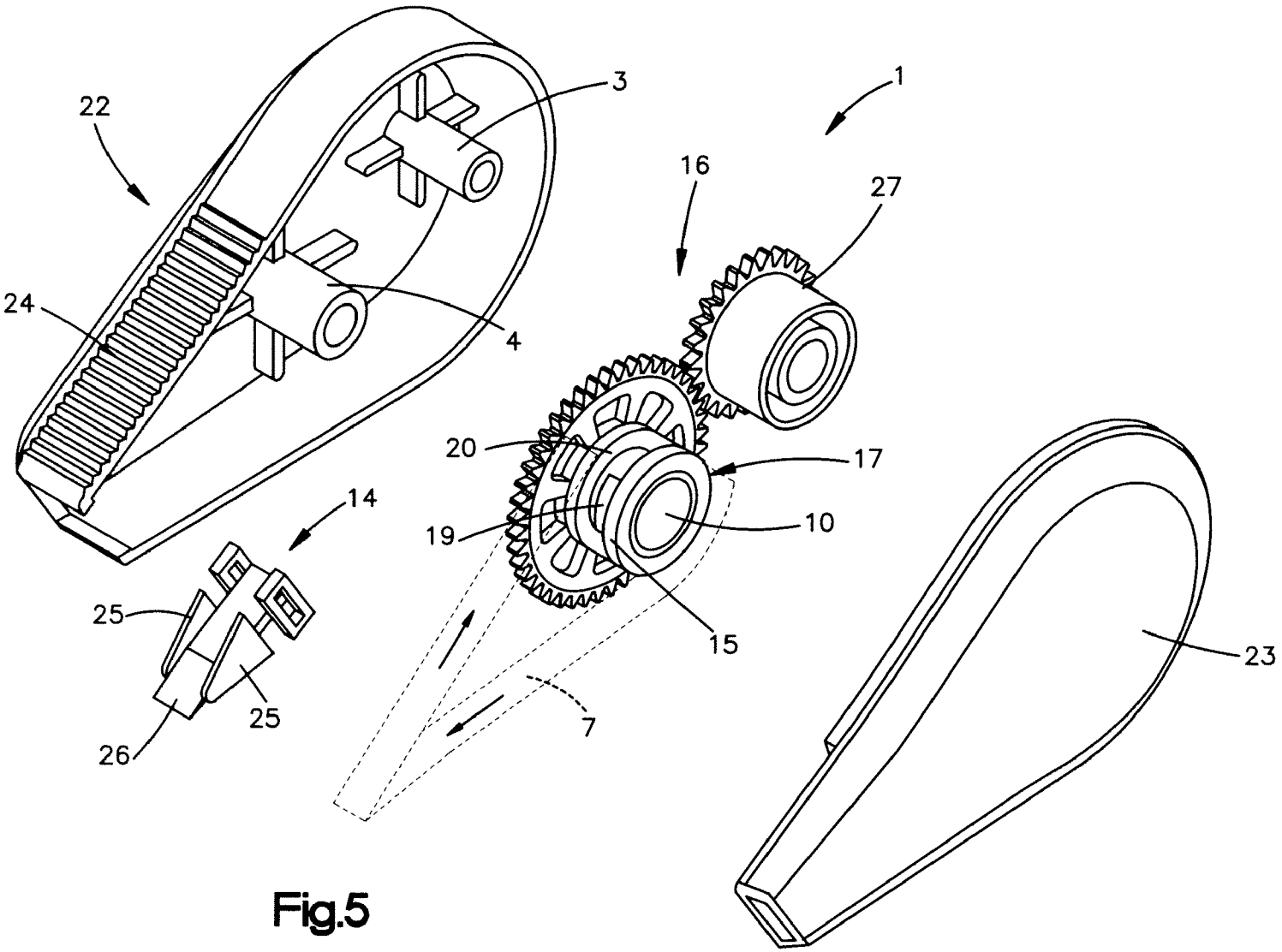
FIG. 5 shows an exploded view of a correction device according to an embodiment of the present invention.

FIG. 5 is an exploded view of the correction device 1, showing in greater detail the driving mechanism 16 with integrated frictional clutch 17. The main components of the correction device 1 shown in FIG. 5 are the lower body 22 of the casing 2 on the inner surface of which respective support shafts or take-up reel axle boss and supply reel axle boss, respectively, 3 and 4 are provided. On an outer surface of the lower body 22, grip ribs 24 are provided on which a finger tip is to be placed when using the correction device. Another main component is the tip 14 comprising two guiding wings 25 and an application edge 26, around which the correction tape 7 is lead and which is to be pressed and moved on the surface of a substrate, when the correction device 1 is used. The third main component shown in FIG. 5 is the driving mechanism 16 with integrated frictional clutch 17 functioning to unwind the correction tape 7 from the supply reel 6 and to wind the used correction tape 6 automatically onto the take-up reel 5. On the outer circumferential surface 15, the radial circumferential groove 20 is provided in which the elastic tensioning member 19 is accommodated. Here, since the supply reel cylinder 9 is mounted on the cylindrical boss 10, the elastic tensioning member 19 is stretched to have a ring shape adapted to the outer shape of the cylindrical boss 10. The fourth main component of the correction tape is the upper body 23 to form a closed casing 2 together with the lower body 22, when all components are in an assembled state.

Figure 6:
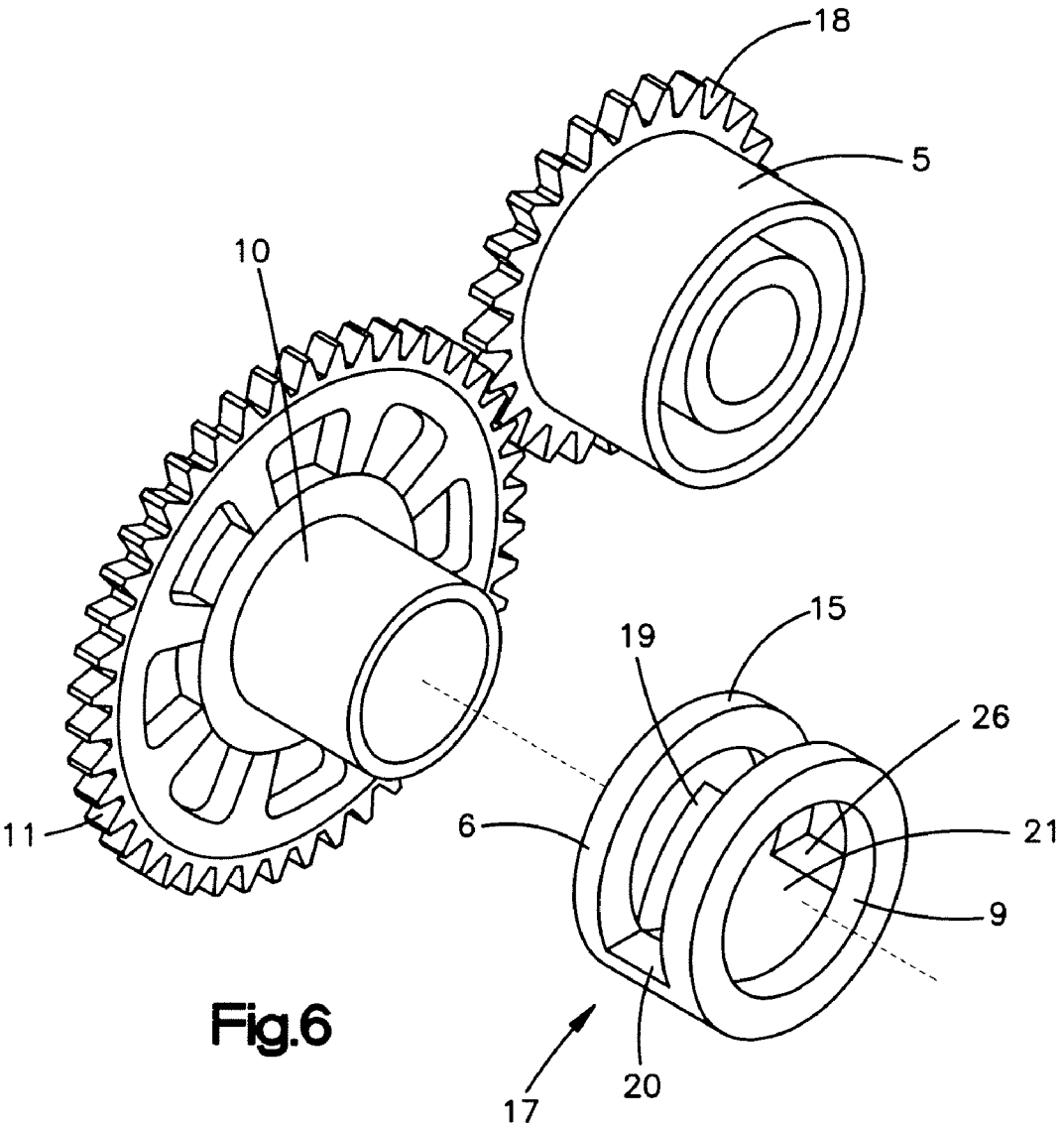
FIG. 6 shows a perspective view of the frictional clutch according to an embodiment of the present invention.

Finally. FIG. 6 shows the details of the frictional clutch 17 again in a perspective view. A driving gear wheel having at its center a cylindrical boss 10 onto which the supply reel 6 is to be rotatably mounted is in engagement with a driven gear wheel 18 carrying the take-up reel 5 by means of a respective tooth profile provided on the outer circumference of the respective wheels 11, 18. The groove 20 provided in the entire outer periphery or outer circumferential surface 15 of the supply reel 6 is at its bottom transected over three sections such that the elastic tensioning element 19 projects inwardly towards a center opening 21 of the hollow supply reel cylinder 9 secantically, when it is in a stress-relieved condition, i.e. when the supply reel 6 is not mounted on the cylindrical boss 10 of the drive gear wheel 11. The transacted groove 20 splits the supply reel 6 into two halts or two coaxial ring shaped members which are connected to each other by three bridging parts 26 where the groove 20 is not transacted at its bottom. When mounted on the cylindrical boss 10, however, due to its elasticity and size, the elastic tensioning element 19 smoothly adapts to the curvature of the cylindrical boss 10 to transmit a frictional force.

Contrasting to the frictional clutch according to prior art, the elastic tensioning element 19 is subject to tensioning rather than being compressed and has a free outer periphery and is free to be deflected outwardly inside the groove 20. This construction enables providing a stable frictional force without variations such that the correction tape 7 is reliably transmitted onto a substrate without rupturing.

Advantageous with respect to the assembly of the correction device 1 is that the elastic tensioning element 19 can be simply mounted from outside in the radial groove 20 on the outer circumferential surface 15 of the supply reel 6. This enables a preassembly of the tensioning element 19 and the supply reel 6 and facilitates the production of the correction device 1.

LIST OF REFERENCE SIGNS

1 correction device
2 casing
3 support shaft/take-up reel axle boss
4 support shaft/supply reel axle boss
5 take-up reel
6 supply reel
7 coating film transfer tape
8 coating film transfer tip
9 supply reel cylinder
10 cylindrical boss
11 drive gear wheel
12 O-ring
13 tip opening
14 tip
15 outer circumferential surface of supply reel
16 driving mechanism
17 frictional clutch
18 driven gear wheel
19 elastic tensioning element
20 circumferential groove
21 center opening
22 lower body
23 upper body
24 grip ribs
25 guiding wing
26 bridging part
27 outer circumferential surface of take-up reel

The invention claimed is:

1. A correction tape device, comprising:

a casing having an upper body and a lower body, said casing being provided with a tip opening, through which a tip for applying a correction tape onto a surface of a substrate extends;

a drive gear wheel in the center of which a cylindrical boss is provided on which a supply reel is arranged having a center opening and a circumferential surface from which the correction tape is to be wound off; and a driven gear wheel which engages said drive gear wheel and on which a take-up reel is arranged having a circumferential surface on which the correction tape is to be wound up, wherein the outer circumferential surface of the supply reel is provided with a circumferential radial groove in which an elastic tensioning element is disposed, the circumferential radial groove being at its bottom transected at least partially such that the elastic tensioning element projects into the center opening secantically, when it is in a stress-relieved condition.

2. The correction tape device according to claim 1, wherein the upper body of the casing is provided with a supply reel axle boss for mounting the drive gear wheel and the supply reel thereon and with a take-up reel axle boss for mounting the driven gear wheel and the take up reel thereon.

3. The correction tape device according to claim 1, wherein the lower body of said casing is provided with a supply reel axle boss for mounting said drive gear wheel and the supply reel thereon and with a take-up reel axle boss for mounting said driven gear wheel and the take-up reel thereon.

4. The correction tape device according to claim 1, wherein the lower body of said casing is provided with a supply reel axle boss for mounting said drive gear wheel and the supply reel thereon and with a take-up reel axle boss for mounting said driven gear wheel and the take-up reel thereon.

5. A correction tape device, comprising:

a casing having an upper body and a lower body, said casing being provided with a tip opening, through which a tip for applying a correction tape onto a surface of a substrate extends;

a drive gear wheel in the center of which a cylindrical boss is provided on which a supply reel is arranged having a center opening and a circumferential surface from which the correction tape is to be wound off; and a driven gear wheel which engages said drive gear wheel and on which a take-up reel is arranged having a circumferential surface on which the correction tape is to be wound up, wherein the outer circumferential surface of the supply reel is provided with a circumferential radial groove in which an elastic tensioning element is disposed, the circumferential radial groove being at its bottom transected at least partially such that the elastic tensioning element projects into the center opening secantically, when it is in a stress-relieved condition, and wherein the take-up reel and the supply reel are laterally spaced apart from each other.

6. The correction tape device according to claim 1, further comprising:

a frictional clutch comprising:

a rotatable supply reel with a circular center opening; and a rotatable take-up reel arranged laterally spaced apart from said supply reel, said take-up reel having an outer circumferential surface onto which a correction tape is wound up and said supply reel having an outer circumferential surface from which the correction tape is to be wound off, wherein the outer circumferential surface of at least one of said supply reel and said take-up reel is provided with a radial groove in which an elastic tensioning element is disposed, the radial circumferential groove being at its bottom at least partially opened such that the elastic tensioning element is biased into the center opening.

7. The correction tape device according to claim 6, wherein the elastic tensioning element is made from an elastomer, e.g., from rubber.

8. The correction tape device according to claim 6, wherein the groove is transected at its bottom over the circumference of said supply reel such that it separates said supply reel into two coaxial ring shaped members connected to each other by at least two bridging parts, where the bottom of the groove is not transected.

9. The correction tape device according to claim 6, wherein the elastic tensioning element is pre-assembled on the supply reel.

10. The correction tape device according to claim 6, wherein the elastic tensioning element in a stressed condition adapts the circular shape of said supply reel.

11. The correction tape device according to claim 6, wherein the elastic tensioning element has a ring shape.

12. The driving mechanism according to claim 6, wherein the drive gear wheel and the driven gear wheel are provided with respective teeth over their entire respective circumferences.

* * * * *